United States Patent [19]

Milner

[11] 4,116,126

[45] Sep. 26, 1978

[54] APPARATUS FOR PRINTING ON COMPRESSIBLE MATERIAL

[76] Inventor: Donald L. Milner, 766 Brookside Cir., Elmira, N.Y. 14903

[21] Appl. No.: 729,200

[22] Filed: Oct. 4, 1976

[51] Int. Cl.[2] ..... B41F 7/02

[52] U.S. Cl. ..... 101/217; 101/376

[58] Field of Search ..... 101/217, 219, 376, 177

[56] References Cited

U.S. PATENT DOCUMENTS

| | | | |
|---|---|---|---|
| 1,989,375 | 1/1935 | Meyercord | 101/177 |
| 2,208,047 | 7/1940 | Durup | 101/217 |
| 2,421,823 | 6/1947 | Allen et al. | 101/217 X |
| 2,893,320 | 7/1959 | Jones | 101/376 UX |
| 3,106,891 | 10/1963 | James | 101/376 |
| 3,261,289 | 7/1966 | Cash et al. | 101/217 X |
| 3,263,606 | 8/1966 | Poynter | 101/217 X |

*Primary Examiner*—Clifford D. Crowder

[57] ABSTRACT

Apparatus for printing on compressible material providing cushioning means to prevent the compression or distortion of the compressible material while imparting thereto a clear printing impression. The apparatus comprises an image transfer station including a plate cylinder which is rotatably mounted and adapted to releasably mount thereon a printing plate. This image transfer station includes pressure means in the form of a cylinder which is coactive with the plate cylinder. A printing blanket is provided which travels between the plate cylinder and the pressure cylinder for receiving the image from the printing plate. The plate cylinder and the pressure cylinder have hard non-compressible surfaces. A further printing station is also combined in the apparatus and includes a pair of rotatably mounted cylinders, each of which is coated with a cushioning means and these cylinders are spaced apart for receiving therebetween the printing blanket and the compressible material, one side of which is in contact with the printing blanket to receive the image therefrom.

1 Claim, 2 Drawing Figures

APPARATUS FOR PRINTING ON COMPRESSIBLE MATERIAL

BACKGROUND OF THE INVENTION

This invention pertains to an apparatus for printing on compressible material, such as corrugated board, without producing any distorting compression on the compressible material so as to produce thereon a clear cut printing on the material.

As far as I am aware, the art is devoid of any showing of a relatively simple adaptation of the conventional lithographic printing means to printing on compressible material without any distortion thereof.

In the conventional printing apparatus, a drive cylinder is provided, a printing blanket is provided, as well as a metallic impression cylinder and what is normally called an offset cylinder. All of these cylinders are of noncompressible material, such as metal, and would if used in a conventional manner on compressible material, compress and distort the compressible material upon which the printing is being transferred.

It is essential in printing, of the character in which I am particularly interested, and wherein a printing blanket of rubber is used, to provide two cylinders of noncompressible material, one of which carries the printing plates and is adapted to transfer the image from such plates to the blanket, and in order to produce a clear cut image on the blanket, it is necessary that the two cylinders between which the blanket travels be of hard, noncompressible material. It has been my experience that it is not possible to produce a true and detailed image on a printing blanket unless each of the cylinders between which the blanket travels are of hard noncompressible material. Thus, it is to be appreciated that a true and detailed image would not be transferred from the printing plates to the blanket if one of these cylinders between which the blanket travels was provided with a soft or cushioning medium about the circumference thereof, the blanket being in contact therewith.

SUMMARY OF THE INVENTION

The present invention has been designed to adapt in a relatively simple but ingenious manner, a conventional printing apparatus into one which will effectively print on a compressible material such as corrugated board without any damaging or distorting compression thereof. Conventional apparatus of the general character in which I am interested would damage and distort the compressible material upon which it is desired to print. Any attempt to use conventional apparatus to print on compressible material would not only damage the material but the printed image would not be sharp, true and detailed.

Compressible material of the type in which I am especially interested, usually consists of a pair of sides or panels between which is disposed the corrugations, and it will be appreciated that any pressure resulting from the printing operation on these two sides will produce distortion in the corrugations disposed between the sides and will not only result in an unusable material but will also result in blurred or unsatisfactory printing.

I have accomplished my purposes as set forth in this disclosure in a relatively simple manner and one which requires relatively few additional elements.

DESCRIPTION OF THE INVENTION

Figure 1:
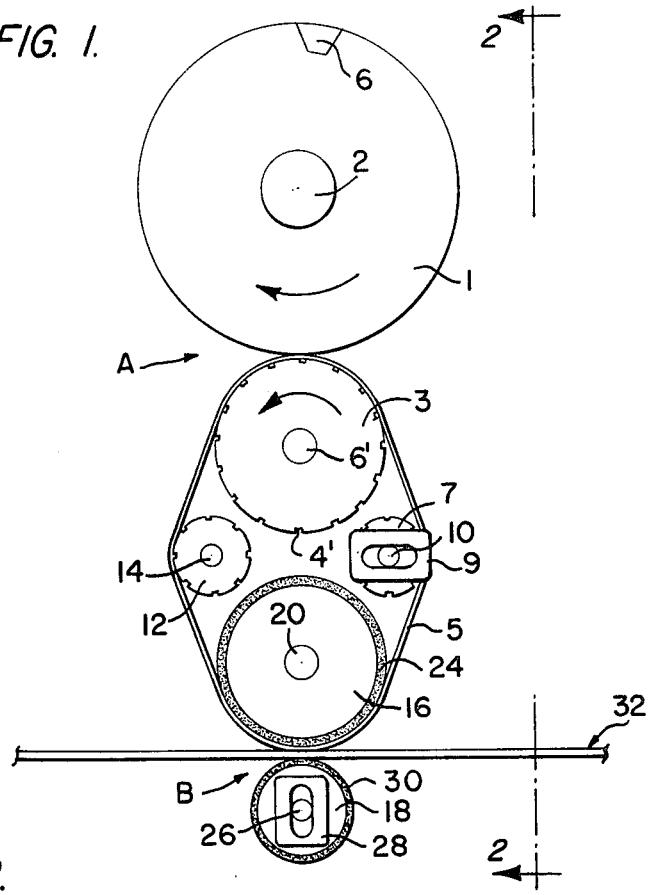
FIG. 1 is an end elevational view of the printing apparatus.
Figure 2:
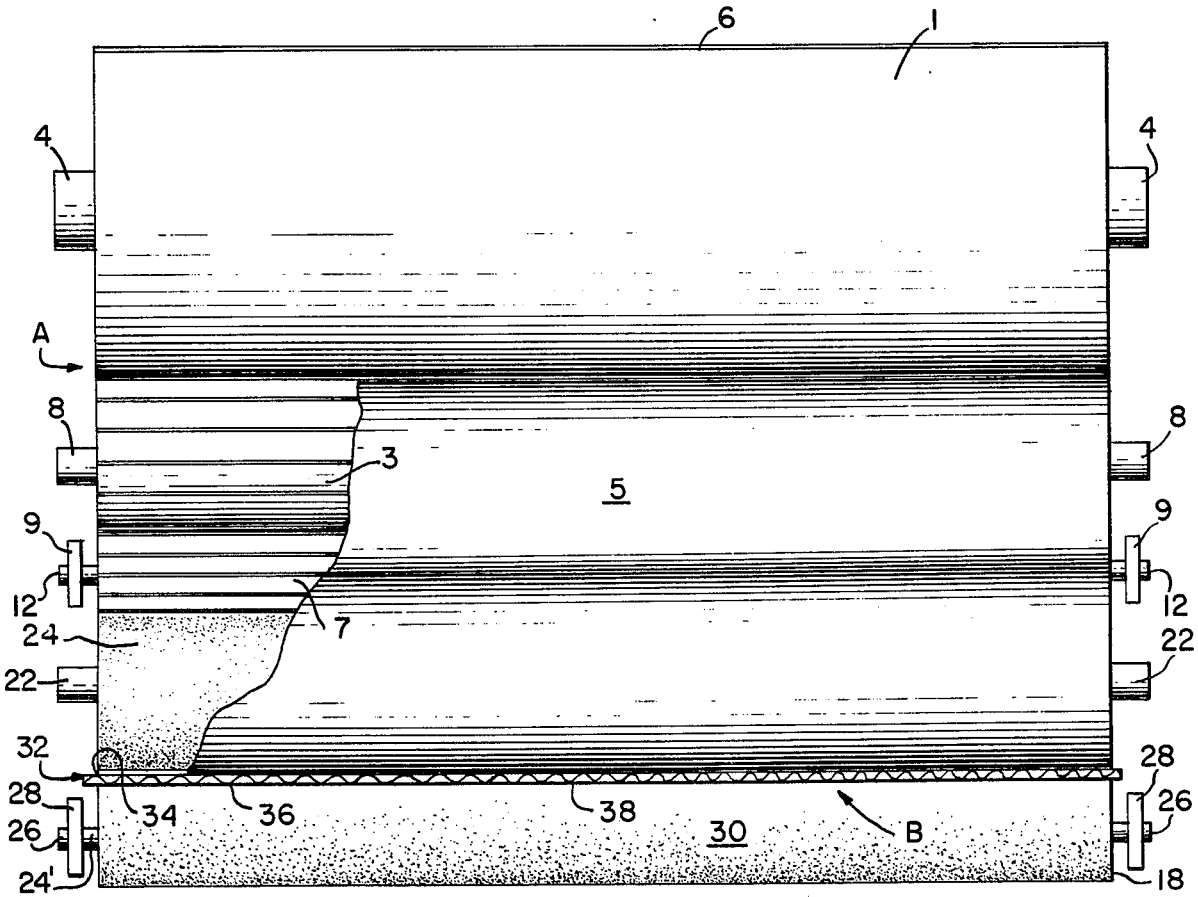
FIG. 2 is a view taken on the line 2—2 of FIG. 1, with the printing blanket cut away.

This printing apparatus which has been especially designed for printing on compressible material without any compression or distortion thereof comprises generally a plurality of rotatable operating elements which are operatively mounted for rotation in any suitable chassis. These operating elements include rotatable cylindrical elements which are so mounted and designed that the desired printing operation and the operation of transferring the images to a printing blanket are successfully achieved. It is also within my contemplation to use this apparatus and method for printing on certain foam plastic material which has an adequately smooth surface.

In the accompanying drawing, I have used the numeral 1 to designate a steel cylinder which comprises the drive or plate cylinder. This cylinder may be gear driven or driven in any suitable manner and includes a shaft 2, the ends of which extend beyond the cylindrical surface of the cylinder as at 4, and may mount gears or other mechanism whereby the cylinder is rotated and also may provide the means for rotatably mounting the cylinder in the chassis. The drive or plate cylinder 1 is adapted to removably mount, in a conventional manner, the usual printing plates (not shown) thereon. The cylinder 1 is provided with a grooved portion 6 in which clamps are mounted to removably hold the printing plates or plates about the cylindrical surface of the cylinder. It is not thought necessary to disclose this releasable attaching means for the printing plates since it is well known in the art and forms no part of this invention. It will be appreciated that the drive or plate cylinder 1 provides a noncompressible hard cylindrical surface and the reason for this structural characteristic of cylinder 1 will become apparent as this description proceeds. The printing plates which are releasably mounted on cylinder 1 and from which the image to be printed is transferred to the printing blanket, as will be described, are metallic and flat when produced and are relatively thin so they may be easily flexed to conform to the curvature of the cylinder. These printing plates which I use in my apparatus are preferably not the standard lithographic plates that require an ink-fountain solution balance, instead they provide a raised image source and no dampener section is necessary.

The apparatus includes what I shall term a pressure cylinder 3 which is of hollow construction and includes a shaft 6' which extends at each end beyond the ends of the cylinder as at 8. The cylinder 3 is mounted in the chassis for the assembly by means of the sahft ends 8. The cylindrical surface of the pressure cylinder 3 is machined to provide shallow serrations which endow the cylindrical surface of the pressure cylinder with nonskid characteristics for a purpose to be hereinafter described. It is to be appreciated that the cylindrical surface of the pressure cylinder 3 is hard and noncompressible. The pressure cylinder is mounted on the chassis and its shaft 6' is in a projected radial plane with respect to the shaft 2 of the drive or plate cylinder so that, a s will be explained, the cylinders 1 and 3 will coact. In the mounting of the pressure cylinder 3, it is spaced from the cylinder 1 a sufficient distance so that the printing blanket 5 may be caused to travel between the two cylinders, the printing blanket 5 being pressed between the hard noncompressible surfaces of the two cylinders 1 and 3. Cylinder 3 is driven by the same power source as cylinder 1 and geared appropriately so as to totally eliminate any slippage between the printing plate and blanket.

I provide a free running rider cylinder 7 having a shaft 10 which extends beyond the ends of the rider cylinder as at 12, and these ends are mounted in a bracket 9 for adjustment of the position of cylinder 7 laterally with respect to the shaft 6'. The bracket 9 may be fixed in the chassis in any suitable manner and the lateral adjustment of this cylinder can be made by matching marks on the cylinder shaft ends to marks on the bracket 9. It will be recognized that a bracket 9 is provided at each end of the cylinder, and the particular adjusting means may take any form as is well known in this art. The surface of the cylinder 7 is preferably provided with shallow serrations thereon. Consideration of the drawings indicates that the cylinder 7 is in a plane laterally disposed with respect to the plane of the shafts 2 and 6'. A further rider cylinder 12 having a shaft 14 is included in the printing apparatus and is disposed in the same horizontal plane as is the shaft 10 of the cylinder 7, however, this cylinder 12 is spaced a substantial distance from the cylinder 7. The cylinder 12 is free running and is not adjustable and it is formed of steel and is also provided with shallow serrations on the surface thereof. As in the case of the shaft 10 of the cylinder 7, the shaft 14 of the cylinder 12 extends at each end (not shown) of the cylinder, so that these ends may be mounted in the chassis of the assembly for rotation of the cylinder 12 when the printing apparatus is operating. For purposes of illustrative clarity, the depths of the serrations 4' in the pressure cylinder 3 are somewhat enlarged and in actual use will be quite shallow and are meant only to create a non-skid surface. This is also the fact with respect to the serrations in the cylinder 7 and the rider cylinder 12.

The printing assembly also includes a pair of impression cylinders 16 and 18. For clarity of description, I shall describe the impression cylinder 16 as being the "primary" impression cylinder and cylinder 18 as being the "secondary" impression cylinder. The primary impression cylinder 16 is provided with a shaft 20 which extends at each end as at 22 so that the cylinder may be rotatably mounted in the chassis in nonadjustable position. The shaft 20 of the cylinder 16 is in line with and in the same plane as the shafts 6 and 2 and, as will be apparent from the drawings, is spaced from the cylinder 3. In order to provide a cushioning and non-skid surface on the circumferential surface of the primary impression cylinder, a rubber coating 24 is applied and caused to adhere thereto. The cushioning surface 24 is on the order of ½ inch thick and is of 30 durometer, preferably natural rubber material so that the best "return" characteristics are obtained. The diameter of the primary impression cylinder 16, including the coating 24, is the same as the diameter of the pressure cylinder 3.

The secondary impression cylinder 18 is provided with a shaft 24' having ends 26 which extend beyond the cylinder and are mounted in an adjusting bracket 28 which is fixed in any suitable manner to the chassis. This adjusting bracket functions as does the bracket 9. The secondary impression cylinder 18 is provided with a cushioning surface 30 for coaction as will be explained, with the compressible material on which the printing is to be applied and with the coating 24 on the primary cylinder 16. The secondary impression cylinder 18 is spaced from the primary cylinder 16 a sufficient distance to receive and to permit the compressible material 32 to travel between these two impression cylinders. By means of the brackets 28 which are provided on each side of the impression cylinder 18, this cylinder may be adjusted toward and away from the primary impression cylinder 16, to thereby vary the tension of the secondary impression cylinder upon the compressible material. It will be evident from consideration of the drawings that the diameter of the secondary impression cylinder is reduced with respect to the diameter of the primary impression roller. The cushioned surface 30 is on the order of ¼ inch thickness and 20 durometer, preferably natural rubber material.

The printing blanket 5 is of rubber and is of a continuous nature. This blanket 5 is raised about the pressure cylinder 3 to travel between the drive or plate cylinder 1 and the pressure cylinder 3, the blanket being in contact with the printing plates which are releasably clamped to the cylinder 1, so that the images on the plates will be transferred to the printing blanket, and this image will be transferred to the blanket in a true, clear cut manner since it is traveling between and in contact with the two hard and non-compressible surfaces of the cylinders 1 and 3. The printing blanket extends over the two rider cylinders 7 and 12 and then is raised about the cushioning surface 24 of the primary impression cylinder 16. It will be recognized that the tension on the blanket may be varied by adjusting the lateral position of the cylinder 7 as explained above. The length of the printing blanket 5 is substantially equal to the circumference of cylinder 1.

The compressible material 32 usually comprises a pair of spaced apart panels 34 and 36 between which are disposed the corrugations 38 which it is desired not to compress or distort when the printing is applied to one of the panels from the image on the blanket. The compressible material travels between the primary and secondary impression cylinders, 16 and 18 respectively, and is caused to travel between these cylinders by any suitable and known means. The adjustment of the secondary impression cylinder 18 permits the application of the printing on compressible materials of different thicknesses, or on foam plastic materials, and it also allows for the varying of pressure on one side of the compressible material.

It will now be evident that I have devised an ingenious arrangement for printing on various types of compressible material without causing any distortion or damaging compression thereof. The apparatus which is disclosed herein provides, in effect, two stations, a station A where the image from the printing plate is transferred to the printing blanket, the blanket traveling between two cylinders each of which is provided with hard circumferential surfaces so that a clear and true image will be transferred to the blanket. The apparatus also involves an additional station B where the image is transferred from the printing blanket to a surface of the compressible material without damage or distortion to this material. At the printing station B, the compressible material travels between two cushioned impression cylinders with one surface in contact with the printing blanket.

What is claimed is:

1. Apparatus for printing on compressible material without compression or distortion thereof, including in combination, a continuous traveling printing blanket, an image transfer station including means mounting a printing plate, pressure means coactive therewith and said printing blanket traveling between said means and said pressure means and in contact with said printing plate for transfer to an image therefrom to the printing blanket, the means and the pressure means having non-compressible surfaces, and a printing station adapted to print an image from the printing blanket on a compression material, said printing station including a pair of coactive rotatable impression means, one of said impression means being fixed against radial movement, the other of said impression means being radially moveable independent of said one of said impression means and being rotatably journaled and supported at each end thereof, and said coactive impression means comprises a primary cylinder and a secondary cylinder, said primary cylinder being of greater diameter than said secondary cylinder and said printing blanket is raised about said primary cylinder and in printing contact with said traveling compressible material and said primary cylinder is of the same diameter as said pressure means, and said means and said pressure means are rotatable cylinders and said impression means are rotatable cylinders having cushioned surfaces and the length of said continuous printing blanket is substantially the same as the circumferential dimension of said means which mounts a printing plate, said means being a single cylinder, the axes of the means mounting a printing plate, the pressure means and the primary and secondary cylinders being in the same projected plane.

* * * * *